United States Patent [19]

Fischer

[11] Patent Number: 4,587,897

[45] Date of Patent: May 13, 1986

[54] ROTARY OFFSET PRINTING MACHINE

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 723,004

[22] Filed: Apr. 16, 1985

Related U.S. Application Data

[63] Continuation of Ser. No. 497,507, May 24, 1983, abandoned.

[30] Foreign Application Priority Data

Jun. 3, 1982 [DE] Fed. Rep. of Germany ..... 3220919

[51] Int. Cl.[4] ..... B41F 7/10

[52] U.S. Cl. ..... 101/137; 101/177; 101/229

[58] Field of Search ..... 101/132, 177, 137, 218, 101/138–140, 142, 143, 144, 179, 220, 225, 229, 231

[56] References Cited

U.S. PATENT DOCUMENTS

| | | | |
|---|---|---|---|
| 643,692 | 2/1900 | Speckbauch | 101/225 X |
| 1,108,223 | 8/1914 | Payne . | |
| 1,709,575 | 4/1929 | Horn | 101/220 |
| 1,916,454 | 7/1933 | Wohlrabe | 101/229 X |
| 2,270,273 | 1/1942 | Davidson | 101/142 |
| 3,049,996 | 8/1962 | Downie | 101/217 |
| 3,203,346 | 8/1965 | Norton et al. | 101/142 X |

FOREIGN PATENT DOCUMENTS

| | | | |
|---|---|---|---|
| 543116 | 2/1930 | Fed. Rep. of Germany . | |
| 2134397 | 1/1972 | Fed. Rep. of Germany . | |
| 2139830 | 7/1973 | Fed. Rep. of Germany . | |
| 2339323 | 2/1975 | Fed. Rep. of Germany | 101/179 |
| 3108807 | 9/1982 | Fed. Rep. of Germany . | |
| 473113 | 6/1914 | France | 101/137 |
| 1328257 | 3/1973 | United Kingdom . | |

*Primary Examiner*—J. Reed Fisher

*Attorney, Agent, or Firm*—Frishauf, Holtz, Goodman & Woodward

[57] ABSTRACT

To improve the versatility of offset printing machines by permitting, selectively, prime printing or prime-and-verso printing, a printing system of at least one plate cylinder (1) in engagement with a rubber blanket cylinder (7) is provided, the plate cylinder having the customary inker (3) and damper (5) associated therewith. Printing is effected against an impression or counter cylinder (9). The impression or counter cylinder is arranged for application of verso print image on the sheet by having an attachment arrangement (13–24) to attach a flexible planographic printing plate (12) on the surface thereof; a further inker (29) is provided, selectively engageable with the planographic printing plate, if verso printing is to be effected. If the printing plate is an offset printing plate, an additional damper may be provided, selectively engageable therewith. Preferably, the diameter of the impression or counter cylinder (9) is smaller than the diameter of an associated dimensioning or bearer ring (11), the difference in diameter (2*a*—see FIG. 3) being at least twice the thickness of the flexible planographic printing plate. The flexible planographic printing plate can be selectively interchanged with other surfaces, such as a metal plate, a rigid impression surface, or an elastic or yielding impression surface, such as a blanket or other similar cover.

4 Claims, 3 Drawing Figures

9
10
11
12
13
14
15
16
17
18
19
20
21
22
23
24
25
26
27
28
b
c 9
a
a
11

ROTARY OFFSET PRINTING MACHINE

This application is a continuation of application Ser. No. 497,507, filed May 24, 1983, now abandoned.

REFERENCE TO RELATED PUBLICATION

Wolfgang Walenski: "Einführung in den Offsetdruck" ("Introduction to Offset Printing"), pages 143,148 and 155.

The present invention relates to printing machinery, and more particularly to a printing system for a sheet printing machine of the rotary offset printing type, having a plate cylinder, with which an inker and damper are associated, at least one blanket cylinder and an impression cylinder, and so arranged that prime and verso printing can be carried out, in which the verso print is applied over the impression cylinder.

BACKGROUND

The referenced literature Wolfgang Walenski: "Einführung in den Offsetdruck"("Introduction to Offset Printing") describes a printing machine for offset printing in which a sheet is passed between two blanket cylinders, each one of which has a plate cylinder associated therewith, and each plate cylinder has its own inker and damper. Prime-and-verso printing is carried out by this machine at the same time. This type of machine requires a separate printing arrangement for prime printing and for verso printing. Some printing machines only include a system for prime printing, and expansion of such a system to permit double-sided printing is not possible since machines designed for prime printing only do not provide space for an additional plate cylinder. Constructing printing machines to be universally applicable for prime and verso printing is frequently uneconomical if, usually, only prime printing is to be effected, and double-sided printing only occasionally. The substantially higher price of a machine having two separate printing systems, one for each side of the sheet, mitigates against such an arrangement unless it is to be used continuously.

Attempts have been made to design machines which are primarily arranged for one mode of printing, but which are more versatile in that change-over to different modes of printing is also possible. The machine described in U.S. Ser. No. 353,235, now U.S. Pat. No. 4,414,896, Nov. 15, 1983, by the inventor hereof, describes a sheet rotary offset printing machine which, selectively, can be used for prime printing or prime-and-verso printing. The machine is so constructed that change-over from prime printing to double-sided printing causes the output per unit time to be half of that of prime printing only. The number of colors which are available for prime printing is decreased by the number of colors which are used for verso printing. Thus, if the machine is used for two-color prime printing, change-over for double-sided printing enables printing on the prime and verso sides only with one color.

A different type of machine is described in German Patent DE-PS No. 21 39 830, based on an invention by the inventor hereof, which describes a multiple printing machine system in which substrate sheets are supplied from a make-ready table to a first printing station having a plate cylinder, a rubber blanket cylinder and an impression cylinder, as is customary in the field. To permit multi-color printing, a group of such printing stations is arranged serially between the make-ready table and a removal apparatus with itermediate transfer drums providing for transport of sheets between the respective printing stations. One or more of such transfer drums may be provided and, additionally, the sheets transported to the respective printing stations, or removed therefrom, are supplied by, respectively, supply drums or removal drums. Each one of the printing stations has its own respective plate and blanket cylinder, with the associted inkers and dampers, and an impression cylinder. The sheet is transferred or passed from a supply drum, transfer drums, and removed from a removal drum after having been printed between the blanket cylinders and the respective impression cylinders of the respective printing stations. In accordance with the disclosure of this patent, it is additionally possible to apply verso printing by so arranging one or more of the transport drums, that is, the supply drum, the transfer drums and the removal drum, that it can carry a printing plate, and to associate an inker with the printing plate.

Double prime-and-verso printing using the direct lithographic printing mode in which the plate cylinder engaging, for example, the prime side of the printing substrate sheet forms the impression cylinder for the plate cylinder applied to the verso side of the sheet—and vice versa—has been described in British Pat. No. 1,328,257, Dahlgren, to which U.S. patent application Ser. No. 862,789, filed Oct. 1, 1969, corresponds. In order to permit double-sided printing, the printing plate applied to the plate cylinder has a hard, durable surface into which ink-receptive image areas are etched to form recesses. These recesses are etched into a dampening fluid receptive surface. Ink is suplied to the recessed image areas of the printing plate, and dampening fluid is supplied to the remaining surface area of the printing plate, such that the surface rejects ink. The printing image is deep-etched into a metal printing plate, for example a trimetal plate.

German Patent Publication Document DE-OS No. 21 34 397, Brodin et al, describes a printing machine which is primarily designed for two-color prime and single-color verso printing, in which a substrate sheet is passed between two rubber blanket cylinders, each having their own inkers and dampers associated with respective plate cylinders, to effect, simultaneously, prime and verso printing from the plate cylinders associated with the two rubber blanket cylinders. A further prime printing image can be transferred by an additional rubber blanket cylinder in engagement—with the substrate sheet between—with one of the rubber blanket cylinders. The additional rubber blanket cylinder has its own plate cylinder, and damper and inker associated therewith. The disclosure includes the comment that, upon use of another method customary in offset printing, the so-called lithographic printing, three impressions can be applied to one side, and no impressions to the other. In this type of operation, the path of the paper web will have to be changed to wrap around one of the rubber blanket cylinders—for example the one previously applying the verso printing, and utilizing the previously used rubber blanket cylinder as an impression cylinder for the plate, which previously was associated with the rubber blanket cylinder now functioning as the impression cylinder.

Various types of printing machines—see, for example, the above-referenced literature—utilize sheet turning drums between successively located printing stations. In such apparatus, a sheet which is passed between two serially arranged printing stations is turned over, so that the second printing station, rather than printing on the same side—for example the prime side—of a sheet, will then print on the reverse, that is, the verso side. Such sheet turning apparatus, in some machines, can be added subsequently as attachments. They have some disadvantages since set-up of the machine for dual-sided printing is much more time-consuming than set-up for single-sided printing only. Further, in order to prevent increased production of scrap, attachments which control the path of the sheet, and utilizing compressed air or suction zones, must be installed. The sheets tend to smear at the turn-over region. The coverage of printed material on the substrate sheet is decreased since a margin must be left not only on the top side, for example, but a similar margin on the bottom in order to permit gripping at the two ends of the sheets by grippers of the turn-over apparatus. Thus, the overall format and coverage of the sheet is not utilized as efficiently as coverage in single-sided printing.

THE INVENTION

It is an object to provide a printing machine which is versatile in that it permits, selectively, prime-only printing, or, if necessary, prime and verso printing, without decrease in output per unit time, which is simple and which can be constructed by using standard and previously used printing system arrangements, if necessary, prime-and-verso printing.

Briefly, a standard offset printing system is provided for prime printing in which a printing station has a plate cylinder, an inker and damper associated therewith, and a rubber blanket cylinder, positioned in image transfer relationship to the plate cylinder. Printing is effected between the rubber cylinder and an impression or counter cylinder, located for passage of a sheet to be printed between the plate cylinder and the impression or counter cylinder.

In accordance with the present invention, the impression or counter cylinder itself forms a support cylinder on which, selectively, various covers including a planographic plate which applies the printing image can be applied. The support cylinder thus can function as an impression or counter cylinder. It includes attachment means to attach thereto, selectively, a flexible planographic printing plate or another surface cover. An inker is provided, positioned in operative relationship to the flexible planographic printing plate.

If the planographic printing plate is a direct lithographic plate, a damper is additionally provided for engagement with the planographic printing plate.

In accordance with a feature of the invention, the diameter of the support cylinder is slightly smaller than the diameter of an associated dimensioning or bearer ring; the difference in diameter should be at least twice the thickness of the planographic plate to be applied to the impression cylinder. The attachment elements for the plate on the support cylinder are so arranged that, selectively, a cover from a set of covers including a wet or dry planographic printing plate, an elastic or a stiff cover can be applied, thereby permitting, selectively, prime-only or prime-and-verso printing.

DRAWINGS

DETAILED DESCRIPTION

Figure 1:
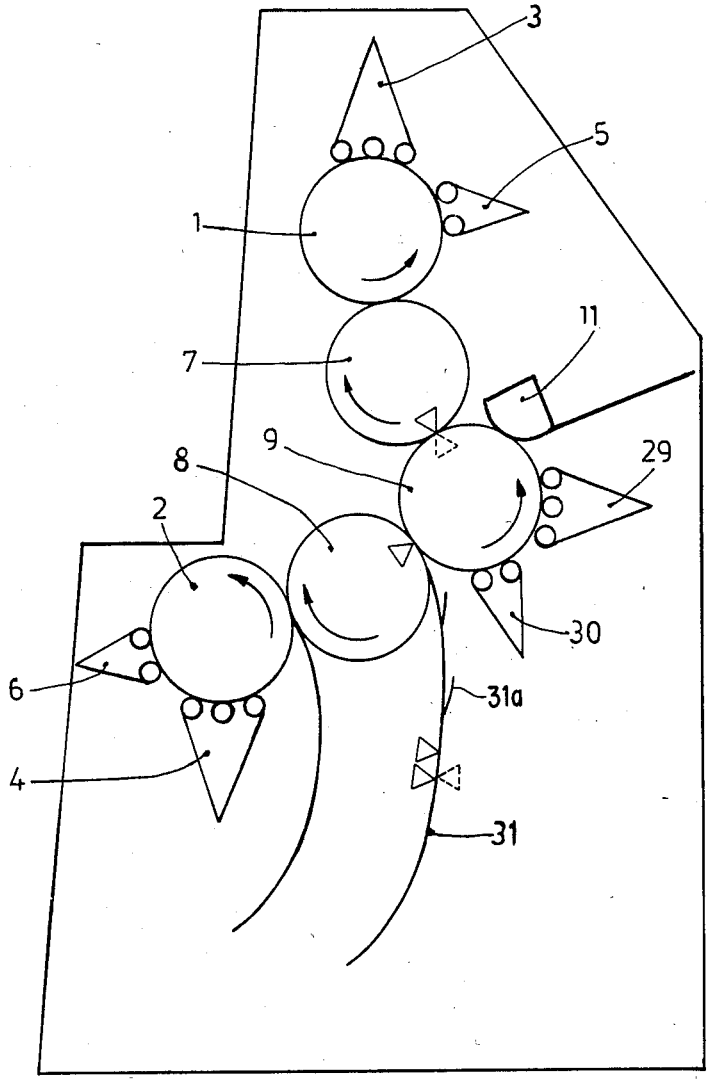
FIG. 1 is a schematic side view of the printing system of the present invention.
Figure 2:
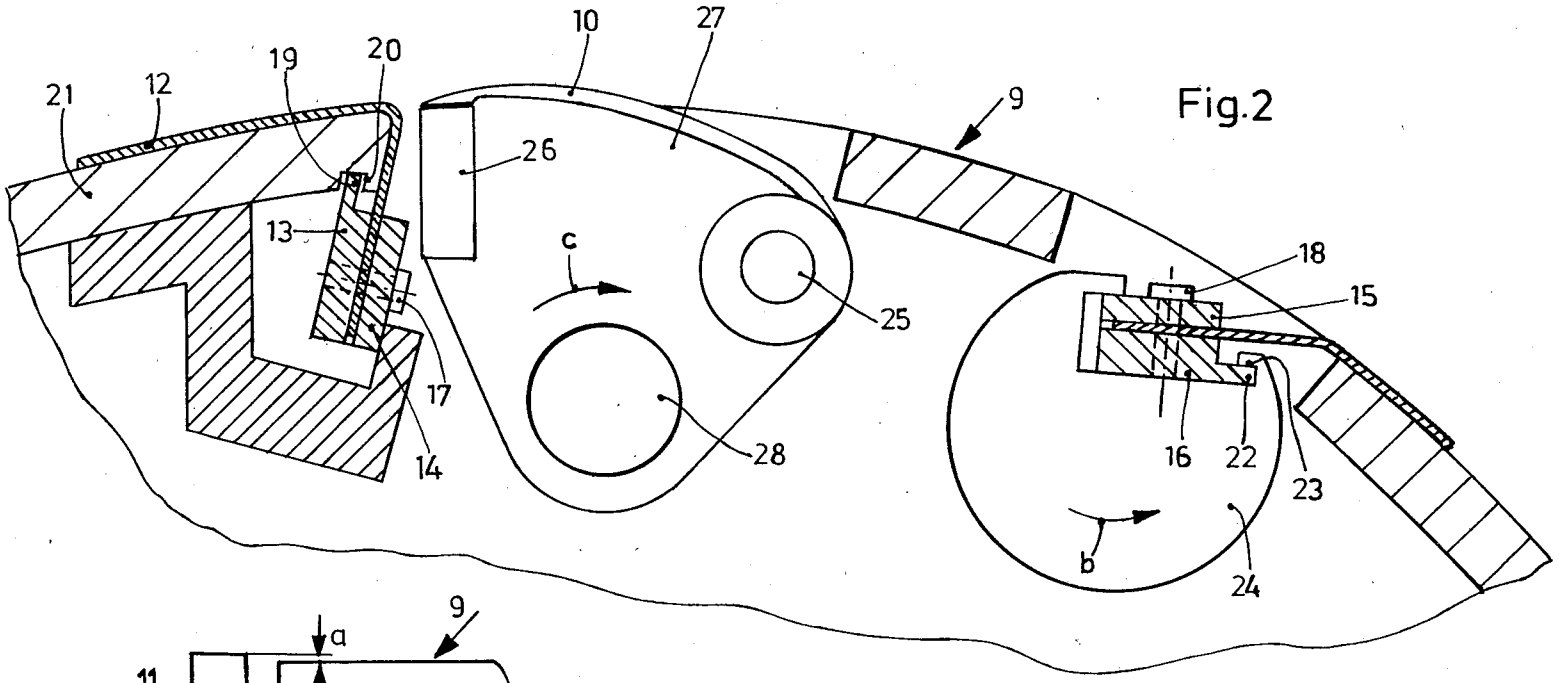
FIG. 2 is a part-pictorial, part-sectional view through the support cylinder.
Figure 3:
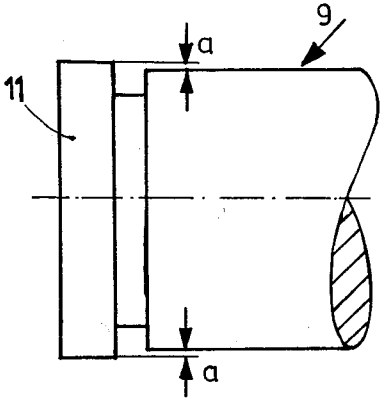
FIG. 3 is a schematic side view of the support cylinder and the associated dimensioning or bearer ring.

Referring first to FIG. 1, showing the printing system in schematic representation: Two plate cylinders 1, 2 each have an inker 3, 4, and a damper 5, 6 associated therewith. The plate cylinders transfer the respective images to rubber blanket cylinders 7, 8. A support cylinder which may function, on one mode of operation, as an impression cylinder is provided, which—see FIG. 2—includes sheet grippers 10.

In accordance with a feature of the invention, the diameter of the cylinder 9 is smaller by the dimension 2*a* than the diameter of an associated dimensioning ring or bearer ring 11. The dimension a corresponds at least to the thickness of a planographic plate 12 (FIG. 2) which can be stretched over the circumference of the cylinder 9.

Two clamping strips 13, 14, 15, 16, attached to the respective ends of the planographic plate 12 (see FIG. 2), are attached to the plate by screws 17, 18. The pair of strips 13, 14 can be inserted and retained within a groove 20 in the cylindrical circumference 21 of the cylinder 9. Preferably, strip 13 is formed with a projecting ridge 19 which engages the groove 20. Similarly, the pair of strips 15, 16 is arranged so that one of the strips, for example strip 16 is formed with a projecting ridge 22 which can hook into a groove of a tensioning shaft 24, which is rotatably retained between the side walls of the cylinder 9. Upon rotation of the shaft 24 in the direction of the arrow b, and then clamping the shaft 24 in the rotating position by any suitable means, for example compression nuts, the plate 12 can be securely stretched over the circumference of the cylinder 9. The system is so arranged that the plate 12, upon loosening of the shaft 24, can be readily removed and exchanged for different plates to which similar end strips 13–16 have been attached.

The grippers 10 are essentially conventional. In order to permit easy insertion of the end strips 13, 14, grippers 10 together with a gripper engagement or counter strip 26, and the respective operating shaft 25 therefor, are all retained between two end plate elements 27; only one such axially positioned plate element 27 is visible in FIG. 2. The plate elements 27 are rotatably secured on or in the end face walls of the cylinder 9. The pivoting shaft 28 can be rotated, for example by a worm drive (not shown) in the direction of the arrow c, so that the entire gripper assembly is rocked out of position and permits easy insertion of the strips 13, 14 and the associated end portion of the element 12 in the groove of the cylinder, and engagement of the ridge 19 in the groove portion 20.

In accordance with a feature of the invention, the planographic printing plate 12 has an inker 29 associated therewith, which can be selectively engaged with the printing plate on the cylinder 9. Further, a damper 30 can be engaged with the cylinder 9.

A transport chain system 31, having grippers 31*a*, is provided to remove sheets fed from a sheet feeding apparatus 11—which can be of conventional type—to a subsequent printing system, or to a stacking arrangement. The subsequent printing system could be constructed similar to that described in connection with FIG. 1.

Operation: In the arrangement shown in FIG. 1, blanket cylinders 7, 8 can apply prime printing on one side of a sheet fed from the sheet feeder 11 with respectively two different colors. The additional possibility presents itself, however, to apply additional printed subject matter on the verso side by stretching a planographic directly lithographic printing plate 12 on the cylinder 9. Since the sheet then will be printed between a planographic printing plate of hard surface, and the blanket cylinders 7, 8 will have an elastic surface, clean printing will be obtained regardless of the quality or the thickness of paper which is fed from the paper feeder 11.

The planographic printing plate applied to the cylinder 9 may be one designed to dry offset printing; for this printing mode, the damper 30 may not be needed, or selectively, can be left out of operation.

The printing system is highly versatile, and the additional components and elements necessary over and beyond the system permitting only prime printing are minor; it is only necessary to provide an additional inker and, if necessary, a damper, and means to clamp the cover—as desired—on the cylinder 9. Thus, the printing system is particularly suitable for print shops which have to carry out prime-and-verso printing only occasionally, but which desire the capability to do so. If the printing system is used only for prime printing, that is, if the inker 29 and the damper 30 are placed out of operation or out of operative engagement from the impression cylinder 9, then a further advantage of the system will be apparent: The cylinder 9, now functioning as an impression cylinder, may have different types of surfaces applied thereto, for example an elastic cover which, in one form, may be a rubber blanket; or a stiff or rigid, or essentially unyielding cover, such as a metal plate. The cylinder 9, thus, can be selectively equipped in accordance with the printing results desired by the customer of the printer, so that the printer can then select a cylinder surface for optimum results, with easy and ready interchange of the surface structure.

The grippers 10 of the cylinder 9 transfer the sheets to the grippers 31*a* of the transport chain system 31 which can be conventional and of any well known and suitable construction. No turning of the sheet is necessary, and smearing of the freshly printed subject matter is thus effectively prevented. The transport chain system transports the sheets either to a stacking or receiving apparatus, or may transport the sheets to a further printing system which, for example, may be identical to the one described.

Various changes and modifications may be made within the scope of the inventive concept.

The usual and customary drive arrangements for the respective rubber cylinders, plate cylinders, cylinder 9 and the chain removal system have been omitted from the drawings for clarity, and can be of any appropriate construction.

The invention has been described in connection with a sheet-fed printing machine; it is equally applicable to web-fed machines, in which case the sheet supply system will be replaced by a web guidance system, and the removal gripper chain by suitable web guide rollers for subsequent transport to folding, cutting, and other utilization apparatus.

I claim:

1. Versatile five-cylinder rotary sheet fed printing machine for, selectively, printing by prime offset printing and prime offset—verso wet or dry planographic printing, for printing on paper sheets comprising a first plate cylinder (1)

a first inker (3) and a first damper (5) associated with said first plate cylinders;

a first rubber blanket cylinder (7) located in image transferring relation to said first plate cylinder (1) to apply a prime print image on a sheet;

a support cylinder (9) positioned for passage of the sheet being printed between the first blanket cylinder (7) and the support impression or counter cylinder (9);

a second plate cylinder (2);

a second inker (4) and a second damper (6) associated with said second plate cylinder;

a second rubber blanket cylinder (8) located in image transferring relation to said second plate cylinder (2) to apply a second prime print on the sheet, said second rubber blanket cylinder being positioned with respect to the support cylinder (9) for passage of the substrate being printed between the second rubber blanket cylinder (7) and the support cylinder (9);

and means for selectively applying a verso print image on the substrate including said support cylinder, comprising a set of cover elements for the support cylinder (9) including (1) a flexible planographic printing plate (12) forming a planographic cover element;

(2) a rigid impression surface or counter surface cover element;

(3) a metal plate cover element;

(4) an elastic or yielding impression or counter surface cover element;

(5) a rubber blanket cover element;

attachment means (13–24) for selectively attaching a selected one cover element of the set on the surface of the support cylinder (9), said attachment means comprising clamping means selectively accepting any one cover element of the set of cover elements;

and a further inker (29) selectively positionable in operative relation to a selected one of said cover elements on the support cylinder (9).

2. Printing machine according to claim 1 further including a further damper (30) selectively positionable in operative relation to said cover element on said support cylinder (9).

3. Printing machine according to claim 1, further including a dimensioning or bearer ring (11) located adjacent at least one axial end face of said support cylinder (9);

and wherein the diameter of the support cylinder (9) is smaller than the diameter of the dimensioning or bearer ring (11), the difference in diameters (2*a*) being at least twice the thickness of said cover element.

4. Printing machine according to claim 3, further including a further damper (30) selectively positionable in operative relation to said cover element on said support cylinder (9).

* * * * *